United States Patent [19]

Tornay

[11] Patent Number: 4,691,660

[45] Date of Patent: Sep. 8, 1987

[54] TUG/BARGE APPARATUS

[75] Inventor: Edmund Tornay, New York, N.Y.

[73] Assignee: Energy Transportation Group Inc., New York, N.Y.

[21] Appl. No.: 862,037

[22] Filed: May 12, 1986

[51] Int. Cl.[4] ..... B63B 35/70

[52] U.S. Cl. ..... 114/248; 114/249

[58] Field of Search ..... 114/242, 248–252, 114/77 A, 77 R, 230

[56] References Cited

U.S. PATENT DOCUMENTS

| | | | |
|---|---|---|---|
| 3,461,829 | 8/1969 | Mosvold | 114/249 |
| 3,512,495 | 5/1970 | Fletcher | 114/249 |
| 3,605,675 | 9/1971 | Clemence | 114/249 |
| 3,645,225 | 2/1972 | Lunde | 114/249 |
| 3,818,854 | 6/1974 | Marriner | 114/249 |
| 3,871,323 | 3/1975 | Roseman et al. | 114/77 R |
| 3,910,219 | 10/1975 | Ono et al. | 114/248 |

OTHER PUBLICATIONS

Pages 69–71 Ship Design and Construction, published 1980 by The Society of Naval Architects and Marine Engineers.

*Primary Examiner*—Jeffrey V. Nase
*Assistant Examiner*—Stephen P. Avila
*Attorney, Agent, or Firm*—Brumbaugh, Graves, Donohue & Raymond

[57] ABSTRACT

Tug/barge apparatus comprises a barge with a notch in the stern shaped to receive the bow of a tug, and the barge being coupled to the tug by a rigid coupling member on the barge which is adapted to be releasably retained in a bearing socket member formed in the bow of the tug. The coupling member is made buoyant enough to float on the water and the bearing member is located in the vicinity of the water line at the bow of the tug so that the two are at essentially the same level when the tug moves into the notch in the stern of the barge to effect a coupling operation. The coupling and bearing members are releasably retained in coupled relation and prevented from inadvertent uncoupling thereof.

3 Claims, 5 Drawing Figures

TUG/BARGE APPARATUS

BACKGROUND OF THE INVENTION

This invention relates to apparatus for push towing barges, and more particularly to new and improved apparatus for coupling a tug positioned at the stern of the barge to the barge for push towing of the latter in a simple and highly effective manner.

The distinct powering advantage of push towing a barge over pulling the barge by a tugboat are well known and a number of tug/barge configurations have been proposed heretofore for this purpose. In one linkage arrangement, the tug is releasably attached to the barge stern through a structural framework, with the tug clear of contact with the barge. Other arrangements have included trunnion mountings adapted to be extended from both sides of the hull of the tug into sockets formed in wing wall extensions of the barge. While such arrangements are effective, they are not entirely satisfactory, because linkage of the tug and the barge can be effected only with some difficulty. Also, the tug cannot always be disengaged quickly enough in a dangerous situation to enable it to come around with attached towline to tow the barge in a conventional manner.

It is an object of the invention, accordingly, to provide a new and improved apparatus for coupling a tug to the stern of a barge that is free from the above-noted deficiencies of the apparatus available heretofore.

SUMMARY OF THE INVENTION

This and other objects of the invention are achieved by providing a barge with a notch in the stern shaped to receive the bow of a tug, and coupling the barge to the tug by a rigid coupling member on the barge which is adapted to be releasably retained in a bearing socket member formed in the bow of the tug. The coupling member is made buoyant enough to float on the water and the bearing member is located in the vicinity of the water line at the bow of the tug so that the two are at essentially the same level when the tug moves into the notch in the stern of the barge to effect a coupling operation. Detent means are provided for retaining the coupling and bearing members in coupled relation and preventing inadvertent uncoupling thereof. With this construction, positive control of thrust and steering is provided, yet the tug and barge can be uncoupled very quickly and easily.

DESCRIPTION OF A PREFERRED EMBODIMENT

The invention may be better understood from the following detailed description taken in conjunction with the accompanying drawings, in which.

Figure 1:
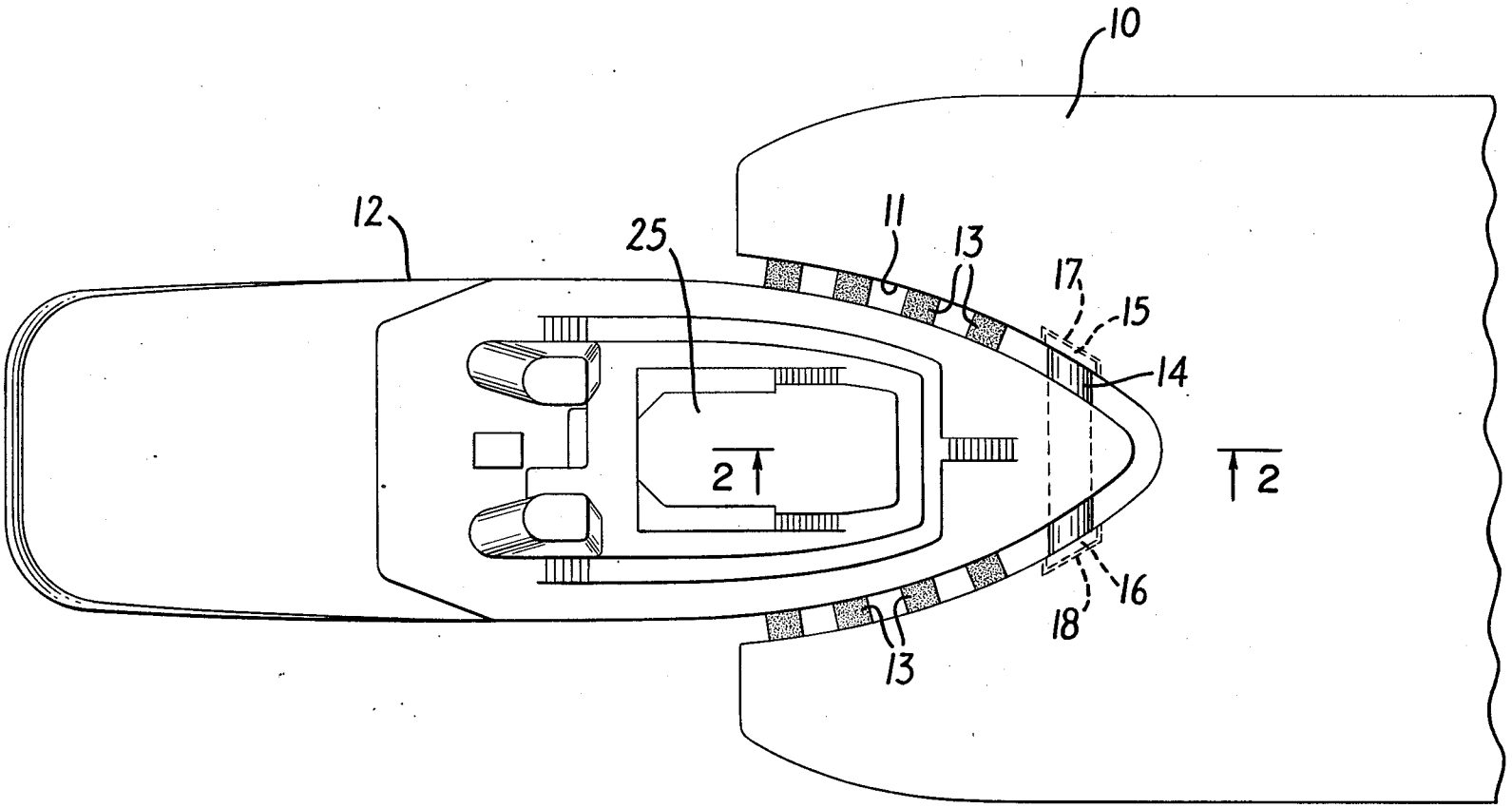
FIG. 1 is a diagrammatic plan view of a coupled tug/barge assembly according to the invention.
Figure 2:
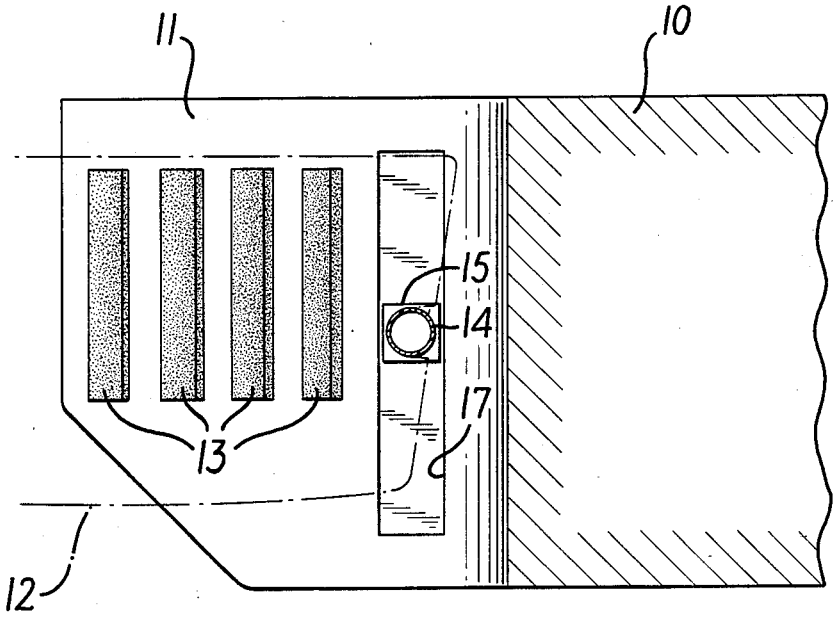
FIG. 2 is a view in section taken along the line 2—2 of FIG. 1, looking in the direction of the arrows.
Figure 2A:
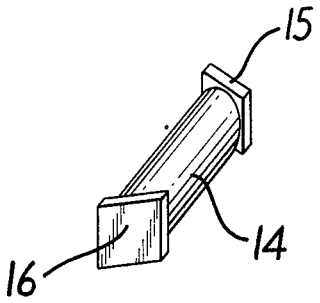
FIG. 2A is a perspective view of a coupling member for use in the tug/barge assembly of FIG. 1.

Referring to FIG. 1, a barge 10 of conventional construction has a notch 11 formed in the stern thereof shaped to conform generally to the bow of a tug boat 12. Suitable bumpers in the form of rectangular strips 13 of resilient material such as rubber are mounted on the wall of the notch 11 as shown. The tug 12 in the position shown is adapted to be coupled to the barge 10 by a coupling member 14 having positive buoyancy so that it normally floats at the water line. The coupling member 14 may be in the form of a hollow cylindrical member having sufficient strength to transmit the push of the tug 12 to the barge 10. The coupling member is provided with enlarged ends 15 and 16 shaped to be slidable in vertical slots 17 and 18 formed in the opposite sides of the barge notch 11 so that it spans the notch as shown in FIG. 1.

Figure 3:
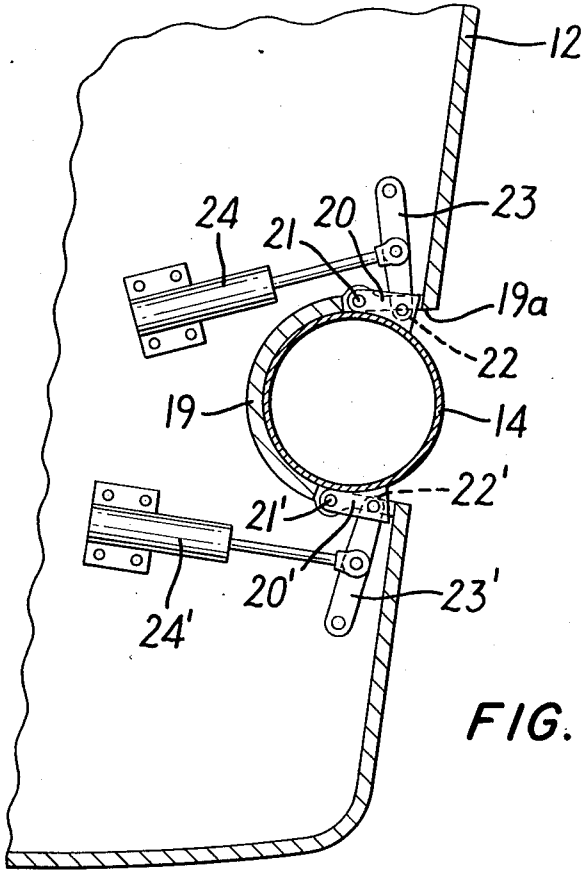
FIG. 3 is a partial schematic diagram in section of part of the bow of the tug in FIG. 1 illustrating one way of securing the tug to the barge coupling member.

When the tug 12 is in the position shown in FIG. 1, the coupling member 14 is adapted to be received in a generally cylindrical notch-like, bearing socket member 19 formed in its bow and extending from side-to-side thereof (FIG. 3). The bearing member 19 preferably has an entrance slot 19*a*, somewhat wider than the coupling member 14 to facilitate the entry of the latter thereinto and is shaped to accommodate the coupling member 14 snugly therein. Also, it is designed according to good engineering practice to have the necessary strength to cooperate with the coupling member 14 to propel the barge 10 by pushing from the rear.

Desirably, means is provided for clamping the coupling member 14 to the bearing member 19 to prevent them from being uncoupled inadvertently as a result of astern thrust, for example. To this end, a clamp 20 may be pivotally mounted at 21 and connected to the movable end 22 of a toggle member 23 adapted to be actuated by a conventional hydraulic ram 24, for example, to move the clamp into and out of clamping position. The ram 24 may be controlled from the pilot house 25 in the known manner.

If desired, a second clamp 20' may be similarly mounted on the opposite side of the bearing member 19, like parts being designated by like primed reference characters.

Figure 4:
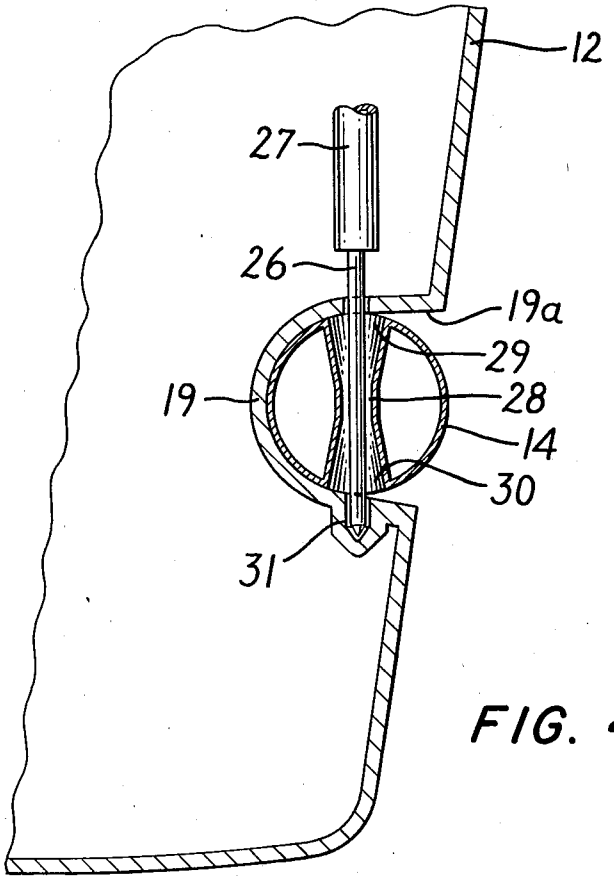
FIG. 4 is a partial schematic diagram in section of part of the bow of the tug in FIG. 1 illustrating another way of securing the tug to the barge coupling member.

FIG. 4 illustrates another way of clamping the coupling member 14 to the bearing member 19. In this embodiment, a locking pin 26 is adapted to be extended and retracted by a hydraulic ram 27 controlled from the pilot house 25, for example, to lock the coupling member 14 to the bearing member 19. This requires that a liquid-tight passage 28 be formed in the coupling member 14. Preferably, the passage 28 should be tapered from wide outside conical ends 29 and 30 towards the center, as shown, to permit some relative motion between the tug 12 and the barge 10 after the two are coupled. In the extended position, the pin 26 is adapted to be seated in a bore 31.

In operation, the tug 12 is maneuvered gently into the notch 11 in the barge 10 until the coupling member 14 is properly seated in the bearing member 19. The hydraulic rams 24 and 24' are then actuated to move the clamps 20 and 20' to the clamping position to retain the barge and tug coupled even in the event of any astern thrust. The tug 12 is then operated to push the barge 10 to the desired destination.

In a typical coupling according to the invention, the coupling member 14 may be, for example, a hollow cylinder about 10 feet long and about 4 feet in diameter made of steel $\frac{3}{4}$ in. thick and sealed by ends 15 and 16 welded thereto. So constructed, the coupling member 14 will have positive buoyancy and will float in the water when positioned in the slots 17 and 18 in the barge 10. Desirably, the coupling member should be reinforced in accordance with good engineering practice to be able to withstand the forces imposed through the coupling in use. For example, a rigid circular transverse plate may be secured inside the coupling member intermediate the ends thereof, and the wall of the coupling member may be thickened where the plate is secured to it.

It will be understood that the invention provides a simple and highly effective coupling of a barge and tug in operations where the barge is to be pushed by the tug from the rear. By utilizing a coupling member having positive buoyancy in cooperation with a bearing member formed in the bow of the tug, the tug and barge can be coupled easily and quickly without danger.

It will be apparent that the specific embodiments described above are susceptible of modification in form and detail within the spirit of the invention. For example, the coupling member may be releasably retained in the tug bearing member by means other than those disclosed herein. The invention is intended to encompass all such modifications as fall within the scope of the following claims.

I claim:

1. In combination a barge having formed in the stern thereof a notch shaped to accomodate the stern of a tug therein, a coupling member having positive buoyancy and mounted in slots formed in said notch so that it spans said notch and floats substantially at the barge water line so as to be able to rise and fall in relation to the barge, and a tug positioned within said notch in the barge and having means cooperable with said coupling member for coupling the tug to the barge, said coupling means comprising a socket in the bow of the tug conforming generally to the shape of said coupling member, said socket extending transversely of the tug and having a forwardly open, transversely extending slot therein to facilitate entry of said barge coupling member thereinto.

2. A combination as described in claim 1 in which said barge coupling member is a hollow cylinder sealed at its opposite ends by end members disposed in said slots and said socket is generally cylindrical in shape and is positioned in the vicinity of the water line of the tug.

3. A combination as described in claim 2 in which means is provided for releasably retaining the coupling member in the socket.

* * * * *